US005474804A

United States Patent [19]

Kubic

[11] Patent Number: 5,474,804

[45] Date of Patent: Dec. 12, 1995

[54] METHOD FOR REPAIRING A TEXTURED CEILING OR OVERHEAD SURFACE

[76] Inventor: Thomas A. Kubic, 97 West Ave., Stratford, Conn. 06497

[21] Appl. No.: 316,100

[22] Filed: Sep. 30, 1994

[51] Int. Cl.[6] ..... B05D 1/36; B05D 5/02; B05B 7/28

[52] U.S. Cl. ..... 427/202; 427/140; 427/258; 427/203; 239/315; 239/654

[58] Field of Search ..... 52/514, 514.5; 427/202, 258, 140, 203; 118/312, 326; 239/310, 315, 143, 650, 654; 15/2371.40

[56] References Cited

U.S. PATENT DOCUMENTS

| | | | |
|---|---|---|---|
| 283,861 | 8/1883 | Cogswell | 427/202 |
| 465,102 | 12/1891 | Tucker | 427/199 |
| 572,907 | 12/1896 | Norton | 222/631 |
| 808,236 | 12/1905 | Hahn | 427/204 |
| 1,715,986 | 9/1925 | Brown | 222/631 |
| 2,302,591 | 11/1941 | Ahern | 43/147 |
| 3,968,274 | 7/1976 | Harris et al. | 427/203 |
| 4,123,005 | 10/1978 | Blunk | 239/327 |
| 5,188,295 | 2/1993 | Stern et al. | 222/631 |

FOREIGN PATENT DOCUMENTS

| | | | |
|---|---|---|---|
| 2416052 | 9/1975 | Germany | 118/326 |

*Primary Examiner*—Shrive Beck
*Assistant Examiner*—Fred J. Parker
*Attorney, Agent, or Firm*—Ware, Fressola, Van Der Sluys & Adolphson

[57] ABSTRACT

A method and apparatus for repairing a textured ceiling or overhead surface. The method for repairing a textured ceiling or overhead surface consists of the following steps: providing an apparatus; applying an adhesive coating to the textured ceiling or overhead surface; introducing the loose, granular material into the hopper; utilizing said means for propelling the loose, granular material out of the open wide end of the hopper and onto the textured ceiling or overhead surface and finally applying a sealant onto the loose, granular material which has adhered to the textured ceiling or overhead surface. The apparatus for repairing a textured ceiling or overhead surface includes a hopper for holding a loose, granular material, the hopper having an open wide end and an open narrow end, the open narrow end having a smaller cross sectional area than the open wide end. The apparatus also includes a retaining screen having openings sized to prevent the loose, granular material from passing through the retaining screen and means for propelling the loose, granular material out of the open wide end of the hopper and onto the textured ceiling or overhead surface.

13 Claims, 1 Drawing Sheet

METHOD FOR REPAIRING A TEXTURED CEILING OR OVERHEAD SURFACE

BACKGROUND OF THE INVENTION

1. Field of the Invention

The present invention relates generally to a method for repairing a textured ceiling or overhead surface and, in particular, relates to an apparatus and method for using the same for repairing a textured ceiling or overhead surface.

2. Description of the Prior Art

Traditionally, textured material has been applied to ceilings and overhead surfaces in two ways. First, a suitable textured material such as sand can be mixed into paint prior to application. Thus, the material is embedded in the paint as it drys. This can be as simple as mixing the material into the paint and then applying the paint mixture with a brush. Of course, more automated methods are available in the form of sprayers. For example, U.S. Pat. No. 5,188,295 issued to Stern et al. on Feb. 23, 1993 discloses a manually adjustable spray applicator for applying paint or other textured material to a surface. Stern's apparatus includes a cylinder and piston for pressurizing plaster or other textured material connected to an exit nozzle for directing the material onto the target surface. Other similar apparatus have been developed. For example, U.S. Pat. No. 1,632,752 issued to Wootton on Jun. 14, 1927 discloses a process and apparatus for coating structural surfaces with a moisture impervious layer. Wootton's process includes applying both a primer coat and a textured material for supporting a final sealing coat. The apparatus disclosed in Wootton includes several temperature controlled, pressurized tanks for holding the moisture impervious fluid and textured material.

As an alternative to mixing textured material directly into paint, the textured material can first be applied to the target surface and then painted. This method involves first applying an adhesive material to the target area. Then, a textured material is blown or sprayed into the prepared surface. After the target area has been covered with material, a sealing coat of paint can be applied over the textured material. For example, U.S. Pat. No. 465,102 issued to Tucker on Dec. 15, 1891 discloses a method of ornamenting walls or ceilings including the application of an adhesive to the target area, followed by the application of a granular material and finally the application of a sealant. Similarly, U.S. Pat. No. 808,236 issued to Hahn on Dec. 26, 1905 discloses a wall finishing process which includes applying an adhesive using compressed air and then applying sand or other suitable granular material to achieve the desired texture. Hahn also discloses an apparatus which includes two compressed air jets attached to feeder tubes which simultaneously apply the adhesive and texture material, the adhesive being applied just ahead of the material as the apparatus is moved horizontally along a wall.

One popular texture created with this second method is known as a "popcorn" texture because of the rather unique look of the round material, similar to that of popped corn. To achieve this look, the material is typically applied using a compressed air machine which blows the material onto the prepared surface at high velocity. This type of machine can be very effective in covering a large surface area quickly. However, these types of machines do not recover excess material which does not adhere to the receiving surface. Although not usually a concern in new construction where the premises are unoccupied and cleanup is relatively simple, this type of equipment is not practical for repairs of existing textured ceilings or overhead surfaces because of the distribution of excess material. Moreover, this type of equipment is also not well suited for repairs of an existing textured ceiling because of the difficulty in matching an existing texture, particularly along the threshold between the old texture and the repaired section. Finally, this type of equipment can be difficult to use in occupied premises to repair an existing textured ceilings because the equipment tends to be quite bulky with the air compressor, assorted hoses and typically large textured material reservoir.

Consequently, a portable, simple and inexpensive method of repairing a textured ceiling or overhead surface which recaptures unused material is highly desirable.

SUMMARY OF THE INVENTION

The present invention is designed to overcome the limitations inherent in the methods and apparatus discussed above and toward this end it contemplates the provision of a novel apparatus for repairing a textured ceiling or overhead surface and a method of using the same.

It is an object of the present invention to provide an apparatus for repairing a textured ceiling or overhead surface which is portable, simple to use, inexpensive to manufacture and which recaptures substantially all of the material not adhering to the ceiling or overhead surface.

It is another object of the present invention to provide an apparatus for repairing a textured ceiling or overhead surface which has the capability to easily vary the velocity at which the textured material exits the apparatus.

The foregoing objects are accomplished, at least in part, by utilizing an apparatus made in accordance with the present invention for repairing a textured ceiling or overhead surface. The apparatus includes a hopper for holding a loose, granular material, a retaining screen and a blow tube. The hopper has an open wide end and an open narrow end with the open narrow end having a smaller cross-sectional area than the open wide end. The retaining screen is supported within the hopper and has openings sized to prevent the loose, granular material from passing through the retaining screen. The blow tube provides means for propelling the loose, granular material out of the open wide end of the hopper and onto the ceiling or overhead surface. The method of the present invention includes the steps of applying an adhesive coating to the ceiling or overhead surface in the area to be repaired, introducing the loose, granular material into the hopper and utilizing the blow tube to propel the loose, granular material out the open wide end of the hopper and onto the adhesive coating on the ceiling or overhead surface.

The present invention offers several advantages over the prior art. First, the present invention is inexpensive to manufacture, lightweight, highly portable and easy to use. In addition to not requiring any powered equipment such as air compressors, the apparatus is easy to clean after use because of its simplicity. Most importantly, the apparatus automatically recovers substantially all of the material which does not adhere to the ceiling or overhead surface being repaired, making it ideal for repairs in occupied premises. Finally, the velocity and volume of the material exiting the apparatus can be easily varied and controlled which enables the texture of a repaired area to be matched with that of the surrounding area.

Other objects and advantages will become apparent to those skilled in the art from the following detailed description read in conjunction with the appended claims and drawings attached hereto.

BRIEF DESCRIPTION OF THE DRAWINGS

The drawings, not drawn to scale, include.

DETAILED DESCRIPTION OF THE INVENTION

Figure 1:
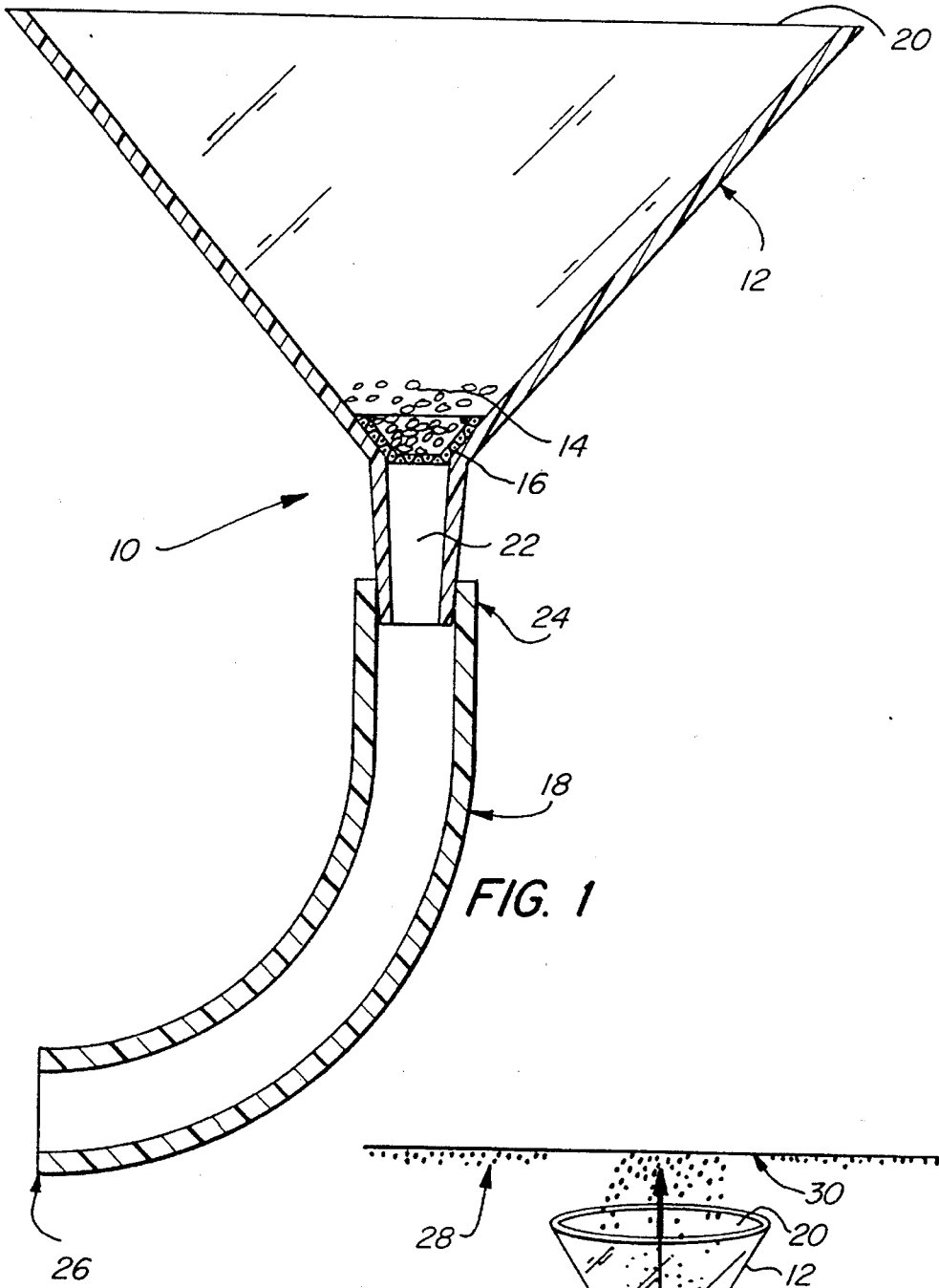
FIG. 1 is a cross-sectional view of an apparatus for repairing a textured ceiling or overhead surface embodying the principles of the present invention.

An apparatus for repairing a textured ceiling or overhead surface is generally indicated at 10 in FIG. 1 and embodies the principles of the present invention. The apparatus includes a clear plastic hopper 12 for holding a loose, granular material 14, a retaining screen 16 and a blow tube 18. The hopper 12 is funnel-shaped and has an open wide end 20 and an open narrow end 22. The retaining screen 16 is supported within the hopper 12 and is designed for preventing the loose, granular material 14 from passing through the retaining screen 16. The blow tube 18 has a first end 24 matingly connected to the open narrow end 22 of the hopper 12 and a second end 26 to be engaged by the mouth of the user. The blow tube 18 provides means for propelling the loose, granular material 14 out of the open wide end 20 of the hopper 12 and is in the form of a flexible, rubber or plastic hose.

Figure 2:
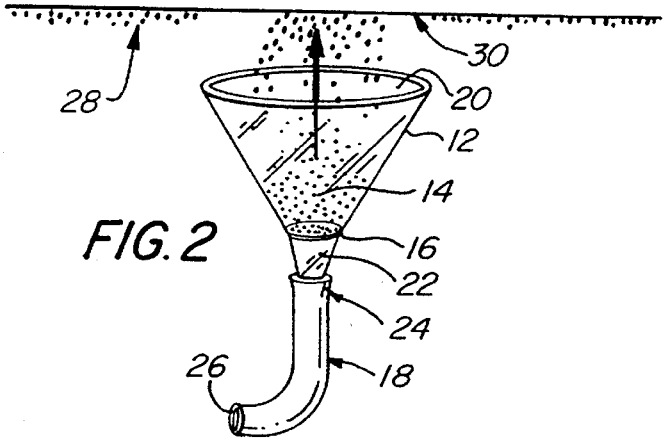
FIG. 2 is a perspective view of the apparatus of FIG. 1 being used in a method for repairing a textured ceiling or overhead surface.

The hopper 12 can be made from many materials, for example, plastic, glass or metal, and have a variety of shapes. Although FIGS. 1 and 2 show the hopper 12 as having a rounded, funnel-like shape, many different shapes are possible. For example, the hopper 12 could be mostly round with a squared off side for use in ceiling comers. Ideally, the open narrow end 22 of the hopper 12 has a smaller cross-sectional area than the open wide end 20 of the hopper 12. In addition, the open wide end 20 of the hopper 12 is appropriately sized so that any loose, granular material 18 not adhering to the ceiling or overhead surface 28 (FIG. 2) falls back into the hopper 12.

The retaining screen 16 is made of metal or plastic although other materials are contemplated. The retaining screen 16 can be a separate element which is inserted into the hopper 12 or can be made as an integral part of the hopper 12. Also, the mesh size of the retaining screen 16 is selected such that gases to be introduced into the second end 26 of the blow tube 18 by the user can travel through the retaining screen 16 to propel the loose, granular material 14 out of the open wide end 20 of the hopper 12 while preventing the loose, granular material 14 from falling back through the retaining screen 16 and into blow tube 18.

Preferably, the loose granular material 14 to be applied with the present invention is lightweight so it can be easily blown out of the apparatus and adhere to the adhesive coating 30. Types of suitable material 16 include vermiculite, perlite and styrofoam, although many other suitable materials are available and can be used.

Turning to FIG. 2, the method for repairing a textured ceiling or overhead surface is illustrated and includes the initial step of providing the apparatus 10 as described above with the loose, granular material 14 therein. The ceiling or overhead surface 28 is prepared to receive an adhesive coating 30 by removing any unwanted dirt or particles to ensure a clean, dry surface. The adhesive coating 30 is then applied to the target area to be repaired on the ceiling or overhead surface 28. The user then orientates apparatus 10 so that the open wide end 20 of the hopper 12 is adjacent to and typically directly under the ceiling or overhead surface 28 where the adhesive coating 30 has been applied. The open wide end 20 of the hopper 12 is oriented in such proximity to the ceiling or overhead surface 28 that loose, granular material 14 which does not adhere to the ceiling or overhead surface 28 will fall back into the hopper 12 and thus avoid one of the several problems of larger, compressed air jet units described above which cannot recover unused material. With the apparatus 10 thus orientated, the user can then blow into the second end 26 of the blow tube 18 to propel the loose, granular material 14 out of the open wide end 20 of the hopper 12 and onto the adhesive coating 30. Since the hopper 12 is made of clear plastic, the user can view the amount and action of the loose, granular material 14 inside the hopper 12 and can correspondingly adjust the gas pressure introduced into the second end 26 of the blow tube 18. Since the blow tube 18 is preferably made of a flexible material such as rubber or plastic or other suitable material, it can be easily manipulated relative to the hopper 12 by the user. After a satisfactory amount of granular material 14 is applied to the ceiling or overhead surface 28, a sealant can then be applied to the loose, granular material 14 which has adhered to the ceiling or overhead surface 28.

Ideally, the adhesive coating 30 is selected so that it will firmly hold any loose, granular material which makes contact with the ceiling or overhead surface. An example of a suitable adhesive coating is the oil based primer spray known under the tradename KILZ, although many other suitable adhesive coatings are available and can be used.

Although the user will typically blow into the second end 26 of the blow tube 18 to introduce a stream of gas into the second end 26 of the blow tube 18 to force the loose, granular material 14 out of the open wide end 20 of the hopper 12, various gases and various means of introducing those gases into the second end 26 are contemplated such as an electric compressed gas source.

The step of applying a sealant to the loose, granular material 14 which has adhered to the ceiling or overhead surface 28 can include the application of paint or other suitable sealant matching the color of the surrounding ceiling or overhead surface. In addition, the sealant can be applied in any number of ways including, for example, being brushed on or sprayed on.

It should be appreciated by those skilled in the art that the method of the present invention allows the user to view the amount and action of the loose, granular material 14 in the hopper 12 and simultaneously adjust the gas pressure introduced into the blow tube 18 to accurately control the amount and velocity of the loose, granular material 14 which makes contact with the target area on the ceiling or overhead surface 28. This is particularly useful along borders between an existing surface and a newly repaired area for achieving a uniform and blended texture.

As will be appreciated from the description provided herein, the present invention provides an effective means and method for repairing a textured ceiling or overhead surface. Although the present invention has been described and discussed herein with respect to one or more embodiments, other arrangements or configurations may also be used that do not depart from the spirit and scope hereof. Hence, the present invention is deemed limited only by the appended claims and the reasonable interpretation thereof.

What is claimed is:

1. A method for repairing a downwardly facing textured ceiling or downwardly facing overhead surface comprising the steps of:

(a) providing an apparatus for repairing a downwardly facing textured ceiling or downwardly facing overhead surface comprising:

(i) a hopper for holding a granular material, said hopper having an open wide end and an open narrow end, said open narrow end having a smaller cross sectional area than said open wide end, (ii) a retaining screen supported within said hopper, said retaining screen having openings sized to prevent granular material from passing through said retaining screen, and (iii) means for propelling granular material out of said open wide end of said hopper and onto the downwardly facing textured ceiling or downwardly facing overhead surface;

(b) applying an adhesive coating to the downwardly facing textured ceiling or downwardly facing overhead surface for bonding granular material to the downwardly facing textured ceiling or downwardly facing overhead surface;

(c) introducing a granular material in a loose condition into said hopper;

(d) orienting said apparatus for repairing the downwardly facing textured ceiling or downwardly facing overhead surface so that said open wide end of said hopper is adjacent to the downwardly facing textured ceiling or downwardly facing overhead surface; and (e) utilizing said propelling means to propel the granular material out of said open wide end of said hopper and onto the adhesive coating so that the granular material is bonded to the downwardly facing textured ceiling or downwardly facing overhead surface and any granular material which does not adhere to the downwardly facing textured ceiling or downwardly facing overhead surface is received back in said hopper through said open wide end.

2. The method for repairing a downwardly facing textured ceiling or downwardly facing overhead surface in accordance with claim 1, wherein said means for propelling the granular material out of the open wide end of said hopper and onto the downwardly facing textured ceiling or downwardly facing overhead surface comprises a blow tube having a first end and a second end, said first end of said blow tube being disposed in mating cooperation with said open narrow end of said hopper for introducing a flow of gas from said blow tube to said hopper to propel the granular material onto said downwardly facing textured ceiling or downwardly facing overhead surface.

3. The method for repairing a downwardly facing textured ceiling or downwardly facing overhead surface in accordance with claim 1, further comprising the step of preparing the downwardly facing textured ceiling or downwardly facing overhead surface to receive the adhesive coating.

4. The method for repairing a downwardly facing textured ceiling or downwardly facing overhead surface in accordance with claim 3, further comprising the step of orienting said apparatus for repairing the downwardly facing textured ceiling or downwardly facing overhead surface, so that said open wide end of said hopper can receive the granular material during said introducing step.

5. The method for repairing a downwardly facing textured ceiling or downwardly facing overhead surface in accordance with claim 3, following said utilizing step, further comprising the step of applying a sealant onto the granular material which has already been applied and has adhered to the downwardly facing textured ceiling or downwardly facing overhead surface.

6. The method for repairing a downwardly facing textured ceiling or downwardly facing overhead surface in accordance with claim 5, further comprising the step of orienting said apparatus for repairing the downwardly facing textured ceiling or downwardly facing overhead surface, so that said open wide end of said hopper can receive the granular material during said introducing step.

7. The method for repairing a downwardly facing textured ceiling or downwardly facing overhead surface in accordance with claim 1, further comprising the step of orienting said apparatus for repairing the downwardly facing textured ceiling or downwardly facing overhead surface, so that said open wide end of said hopper can receive the granular material during said introducing step.

8. The method for repairing a downwardly facing textured ceiling or downwardly facing overhead surface in accordance with claim 7, following said utilizing step, further comprising the step of applying a sealant onto the granular material which has already been applied and has adhered to the downwardly facing textured ceiling or downwardly facing overhead surface.

9. The method for repairing a downwardly facing textured ceiling or downwardly facing overhead surface in accordance with claim 1, following said utilizing step, further comprising the step of applying a sealant onto the granular material which has already been applied and has adhered to the downwardly facing textured ceiling or downwardly facing overhead surface.

10. The method for repairing a downwardly facing textured ceiling or downwardly facing overhead surface in accordance with claim 1, wherein the granular material is selected from the group consisting of vermiculite, perlite and styrofoam.

11. The method for repairing a downwardly facing textured ceiling or downwardly facing overhead surface in accordance with claim 1, during said utilizing step, further comprising the step of recapturing any granular material, which does not adhere to the adhesive coating, in said open wide end of said hopper.

12. The method for repairing a downwardly facing textured ceiling or downwardly facing overhead surface in accordance with claim 5, during said utilizing step, further comprising the step of recapturing any granular material, which does not adhere to the adhesive coating, in said open wide end of said hopper.

13. The method for repairing a downwardly facing textured ceiling or downwardly facing overhead surface in accordance with claim 7, during said utilizing step, further comprising the step of recapturing any granular material, which does not adhere to the adhesive coating, in said open wide end of said hopper.

* * * * *